US006279787B1

(12) United States Patent
Kim

(10) Patent No.: US 6,279,787 B1
(45) Date of Patent: Aug. 28, 2001

(54) BEVERAGE CONTAINER

(76) Inventor: Young-kwon Kim, 13-701 Newton Apt., 341 Bissan 3-dong, Dongan-gu, Anyang-shi, Kyonggi-do (KR)

( * ) Notice: Subject to any disclaimer, the term of this patent is extended or adjusted under 35 U.S.C. 154(b) by 0 days.

(21) Appl. No.: 09/658,318

(22) Filed: Sep. 8, 2000

(30) Foreign Application Priority Data

May 25, 2000 (KR) ..... 00-28415

(51) Int. Cl.[7] ..... B65D 83/00
(52) U.S. Cl. ..... 222/401
(58) Field of Search ..... 222/401, 402, 222/400.8, 553; 215/313, 311, 307

(56) References Cited

U.S. PATENT DOCUMENTS 700,462 * 5/1902 Van Meter ..... 215/313
1,993,255 * 3/1935 Baggett et al. ..... 222/402
2,653,848 * 9/1953 Lee ..... 222/401
2,977,015 * 3/1961 Bartlett ..... 215/313
5,010,928 * 4/1991 Ballas ..... 222/401

* cited by examiner

*Primary Examiner*—Kevin Shaver
*Assistant Examiner*—Patrick M Buechner
(74) *Attorney, Agent, or Firm*—Reed Smith LLP

(57) ABSTRACT

A beverage container is disclosed. The beverage container includes a container body for containing carbonated beverage. A pumping lid assembly for selectively opening and closing the container body is inserted into the opening of the container body. The pumping lid assembly includes an extension cylinder engaged at its lower portion with the upper end portion of the container body. A pump housing is rotatably mounted in the interior of the upper portion of the extension cylinder. A plunger assembly is fitted into the central portion of the pump housing, and designed to pressurize air in the interior of the container body while being moved downward, to suck exterior air from the outside while being moved upward, and to rotate together with the pump housing and align the first and second beverage outlets so as to enable the discharge of carbonated beverage from the container body when being rotated. A beverage guide member is fixed to the interior of the extension cylinder, extended to the interior of the container body, and provided at its sidewall with an air outlet.

4 Claims, 10 Drawing Sheets

BEVERAGE CONTAINER

BACKGROUND OF THE INVENTION

1. Field of the Invention

The present invention relates, in general, to beverage containers and, more particularly, to a beverage container that prevents carbon dioxide from coming out of the carbonated beverage in the beverage container into the vacant space of the beverage container.

2. Description of the Prior Art

As depicted in FIG. 23, a conventional beverage container for accommodating carbonated beverage comprises a container body 1 filled with the carbonated beverage and covered with a lid 2 at its top.

After a user pours the carbonated beverage from the container body 1 following the removal of the lid 2 from the container body 1, the user stops up the container body 1 with lid 2 so as to prevent the carbon dioxide dissolved in the carbonated beverage from coming out of the container body 1 into the atmosphere, in the case that some quantity of the carbonated beverage remains in the container body 1.

However, in the conventional beverage container, since the carbon dioxide comes out of the carbonated beverage in the container body 1 into the vacant space of the container body 1, the carbon dioxide having come into the vacant space is discharged out of the container body 1 into the atmosphere when the user pours the carbonated beverage out of the container body 1 again, thereby causing the deterioration of the flavor of the carbonated beverage.

SUMMARY OF THE INVENTION

Accordingly, the present invention has been made keeping in mind the above problems occurring in the prior art, and an object of the present invention is to provide a beverage container, which is capable of preventing carbon dioxide dissolved in the carbonated beverage of the beverage container from coming out of the beverage into the vacant space of the beverage container by pressurizing the interior of the beverage container, thereby allowing sufficient carbon dioxide to be retained in the beverage and accordingly maintaining the flavor of the carbonated beverage for a long time.

In order to accomplish the above object, the present invention provides a beverage container, comprising: a container body for containing carbonated beverage; and a pumping lid assembly for selectively opening and closing the container body, which is inserted into the opening of the container body, the pumping lid assembly including an extension cylinder engaged at its lower portion with the upper end portion of the container body and provided at its sidewall with a first beverage outlet for discharging carbonated beverage contained in the container body, a pump housing rotatably mounted in the interior of the upper portion of the extension cylinder and provided at its sidewall with a second beverage outlet, a plunger assembly fitted into the central portion of the pump housing, the plunger assembly being designed to pressurize air in the interior of the container body while being moved downward, to suck exterior air from the outside while being moved upward, and to rotate together with the pump housing and align the first and second beverage outlets so as to enable the discharge of carbonated beverage from the container body when being rotated, and a beverage guide member fixed to the interior of the extension cylinder, extended to the interior of the container body and provided at its sidewall with an air outlet.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
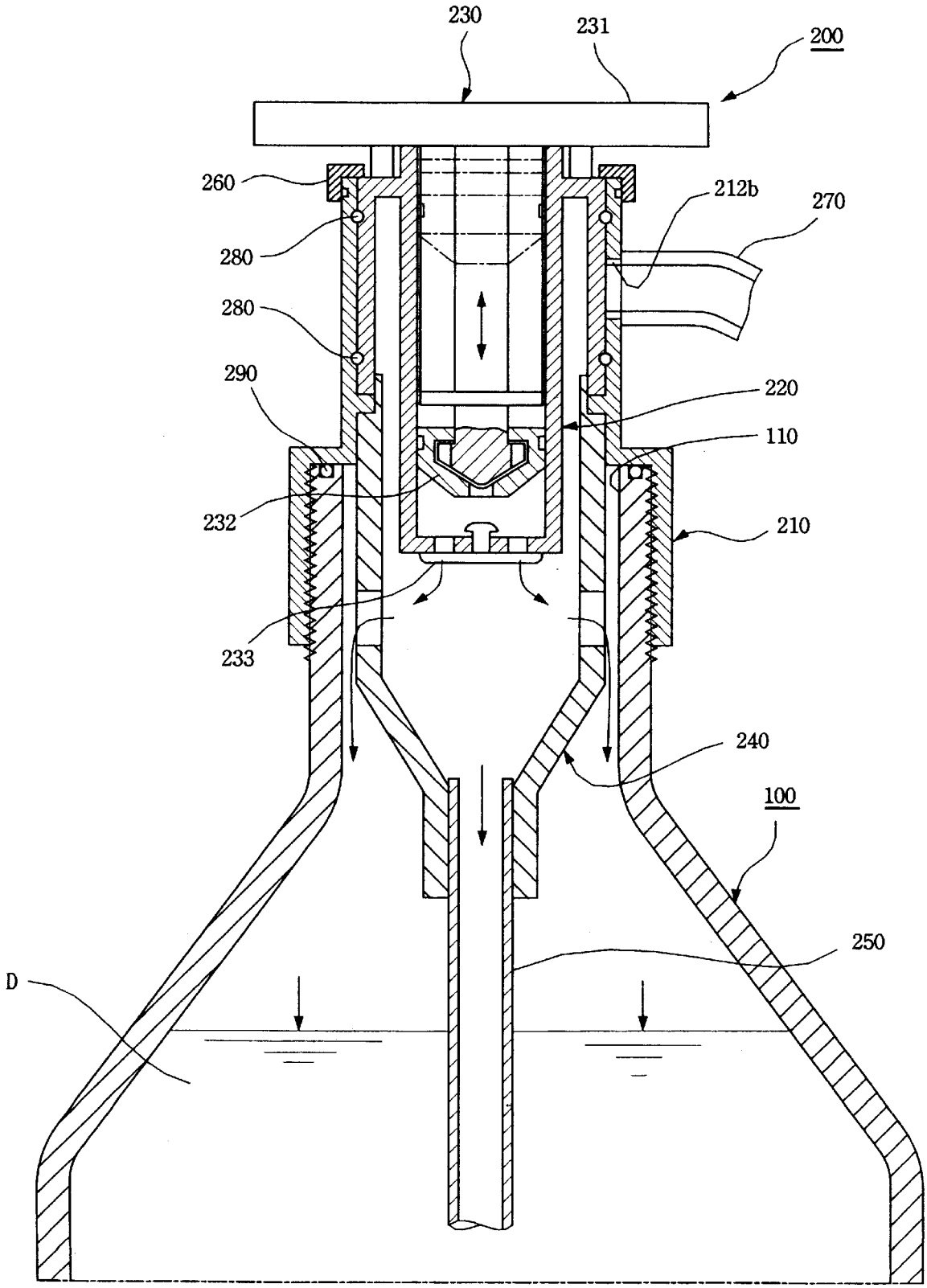
FIG. 1 is a sectional view showing a beverage container in a state where the beverage container cannot discharge beverage out of the beverage container.

Reference now should be made to the drawings, in which the same reference numerals are used throughout the different drawings to designate the same or similar components.

Figure 2:
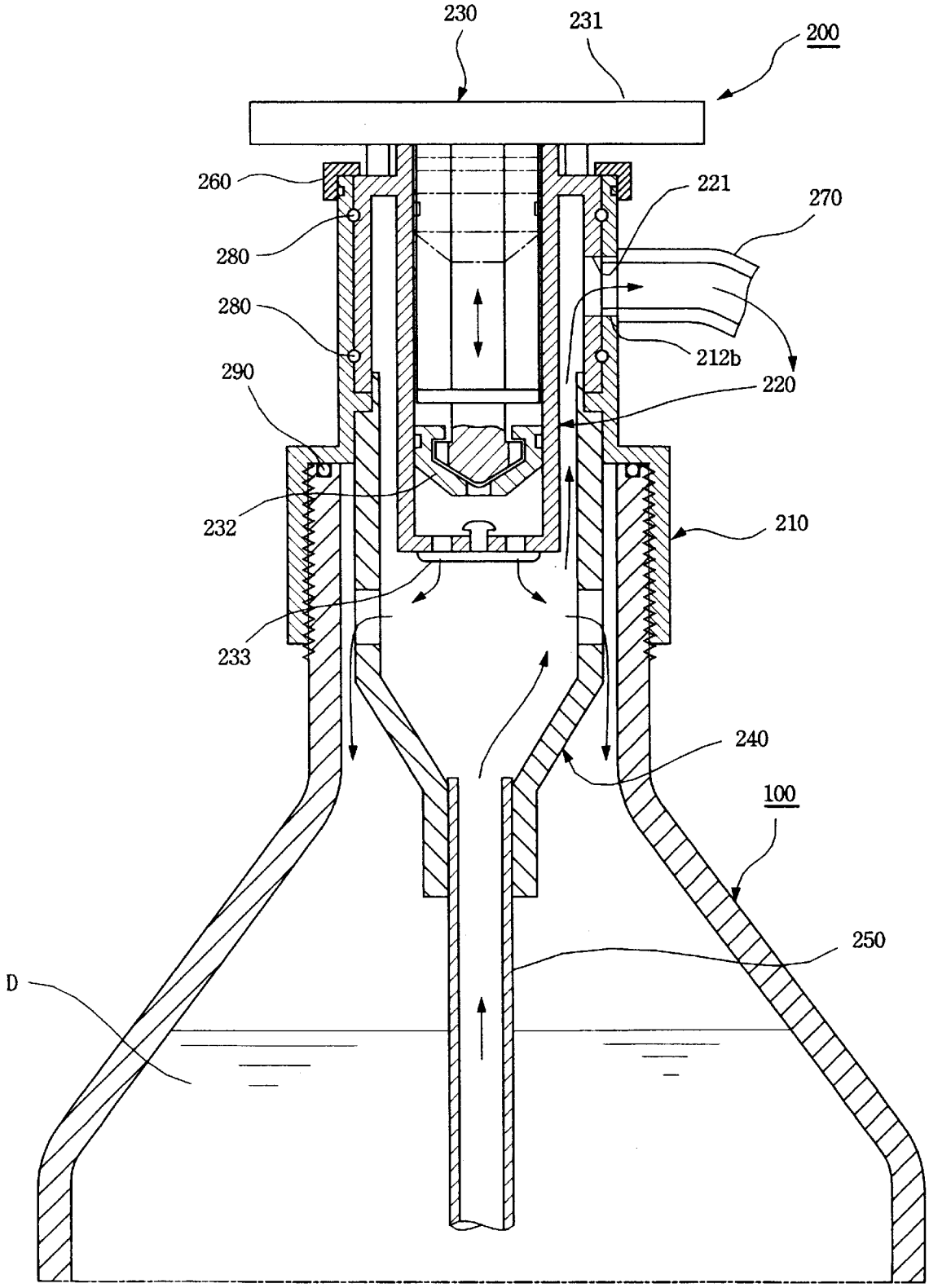
FIG. 2 is a sectional view showing the beverage container in a state where the beverage container can discharge beverage out of the beverage container.
Figure 3:
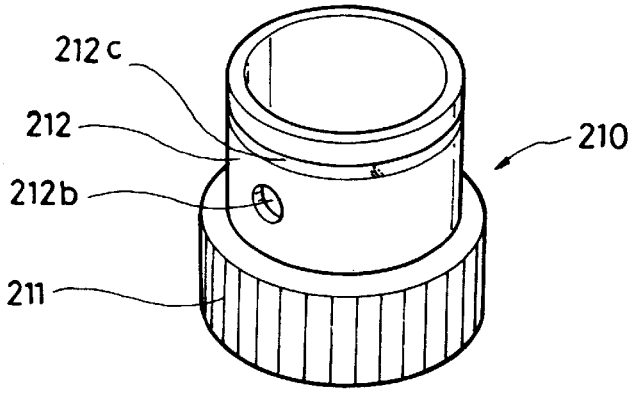
FIG. 3 is a perspective view showing the extension cylinder of the beverage container.
Figure 4:
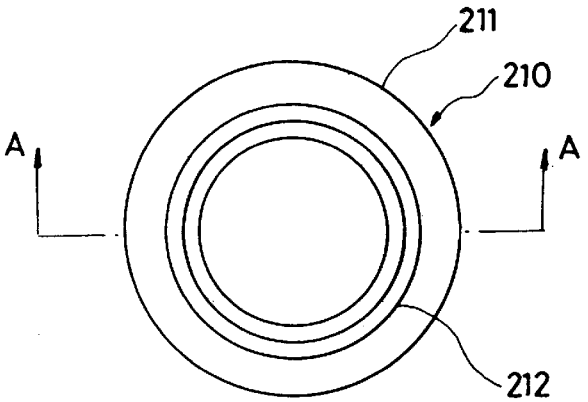
FIG. 4 is a plan view of FIG. 3.
Figure 5:
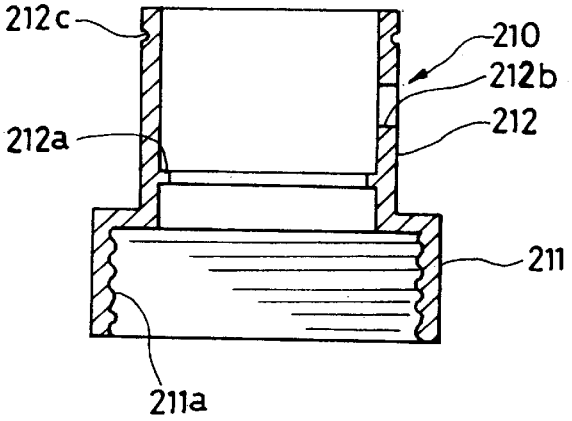
FIG. 5 is a cross section taken along line A—A of FIG. 4.
Figure 6:
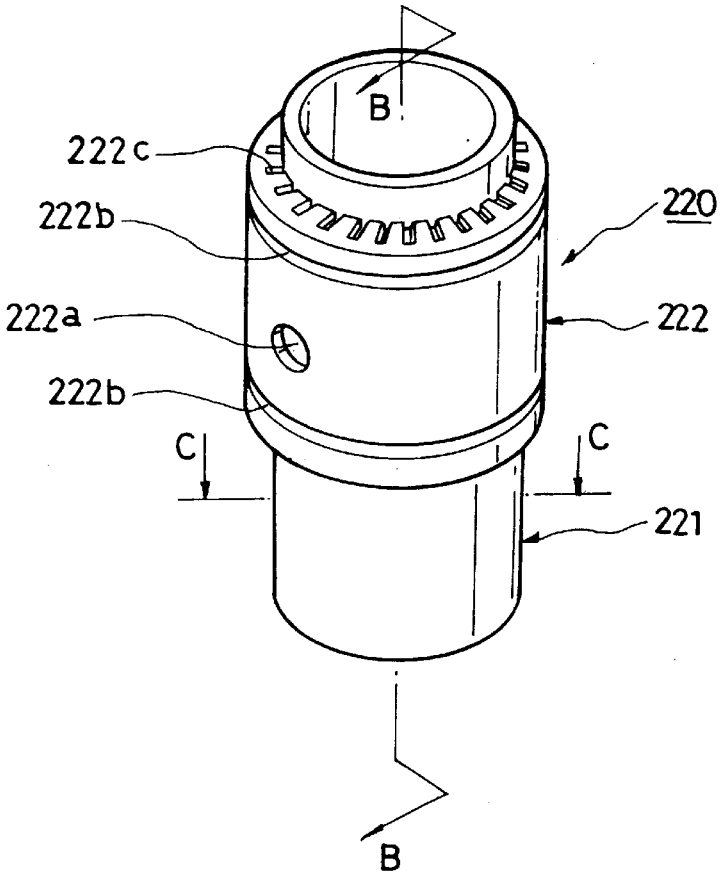
FIG. 6 is a perspective view showing the pump housing of the beverage container.
Figure 7:
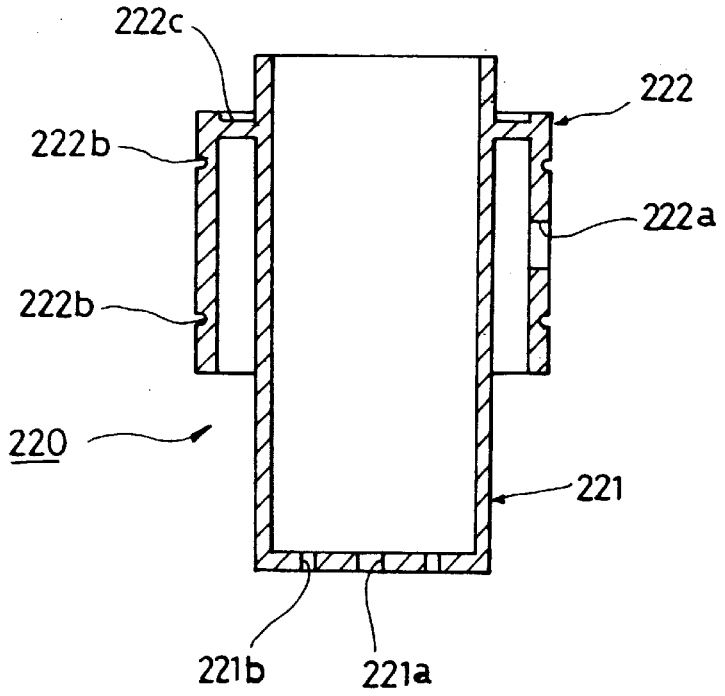
FIG. 7 is a cross section taken along line B—B of FIG. 6.
Figure 8:
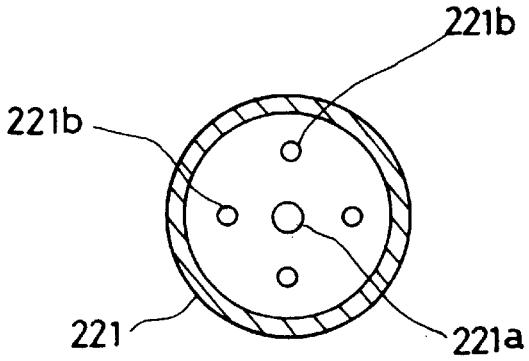
FIG. 8 is a cross section taken along line C—C of FIG. 6.
Figure 9:
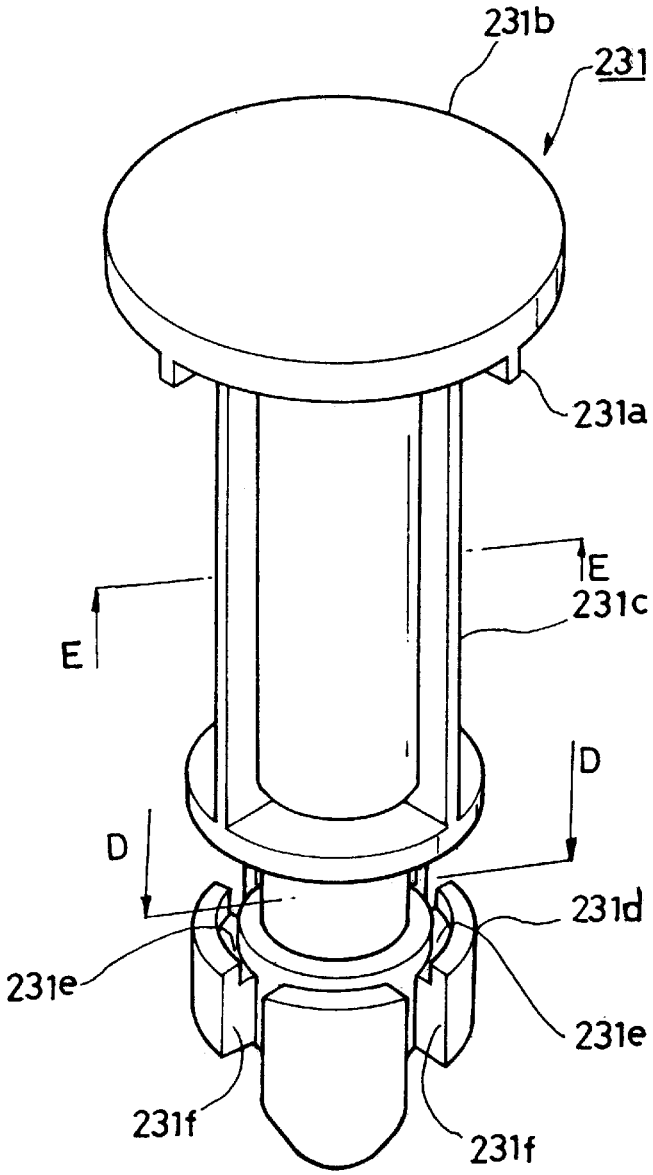
FIG. 9 is a perspective view showing the plunger body of the beverage container.
Figure 10:
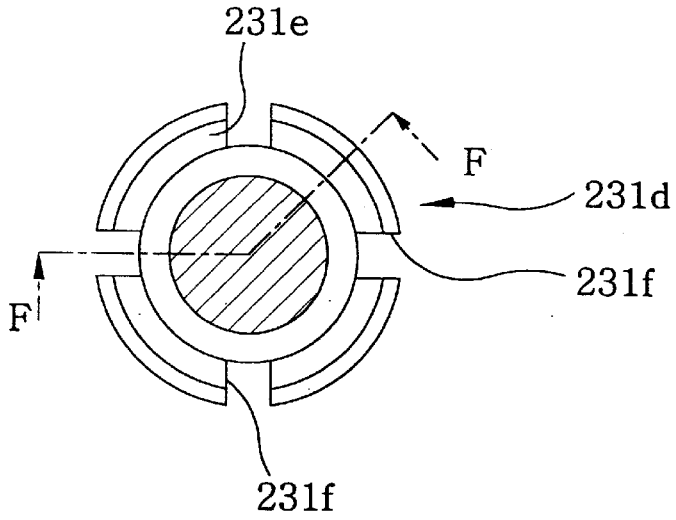
FIG. 10 is a cross section taken along line D—D of FIG. 9.
Figure 11:
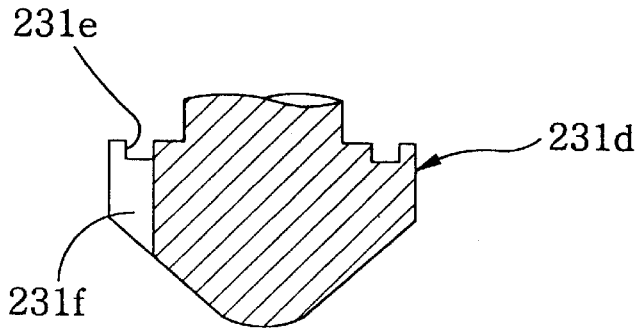
FIG. 11 is a cross section taken along line F—F of FIG. 10.
Figure 12:
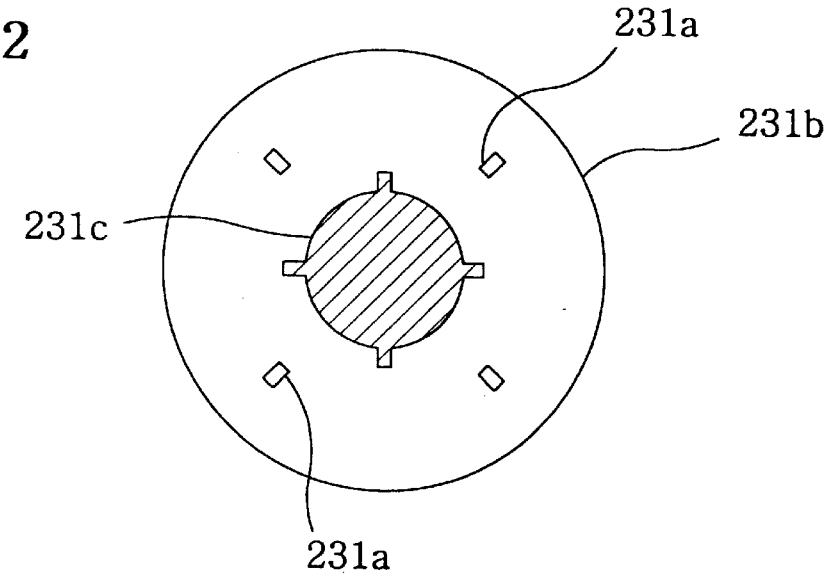
FIG. 12 is a cross section taken along line E—E of FIG. 9.
Figure 13:
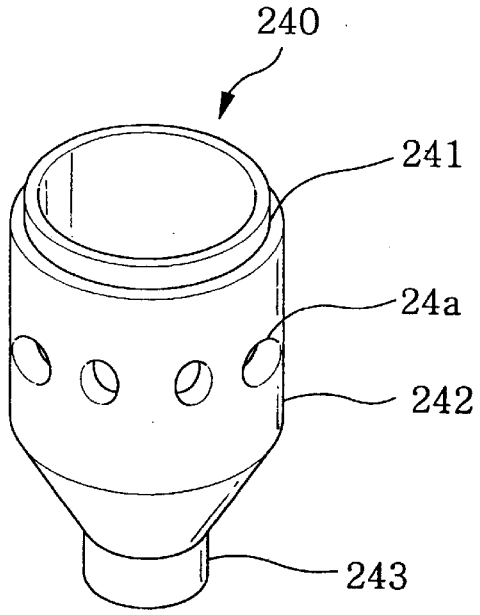
FIG. 13 is a perspective view showing the beverage guide member of the beverage container.
Figure 14:
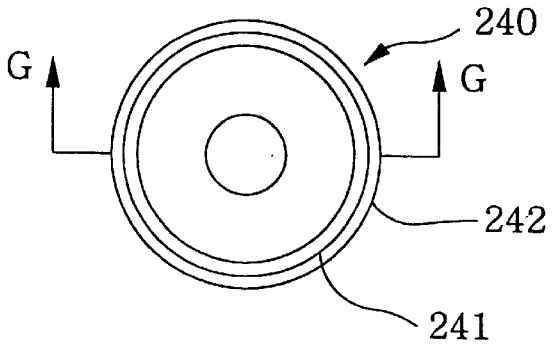
FIG. 14 is a plan view of FIG. 13.
Figure 15:
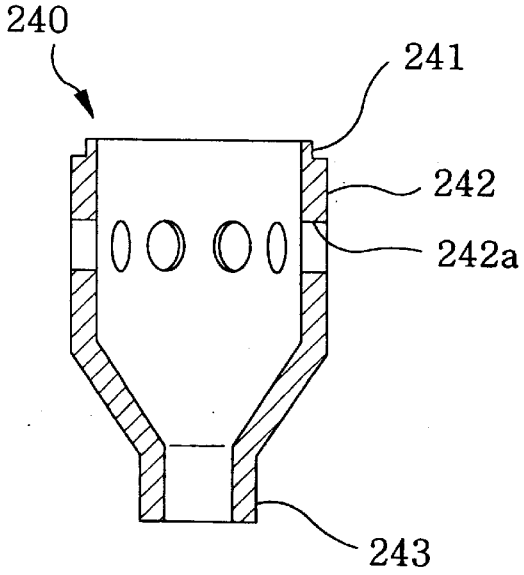
FIG. 15 is a cross section taken along line G—G of FIG. 14.
Figure 16:
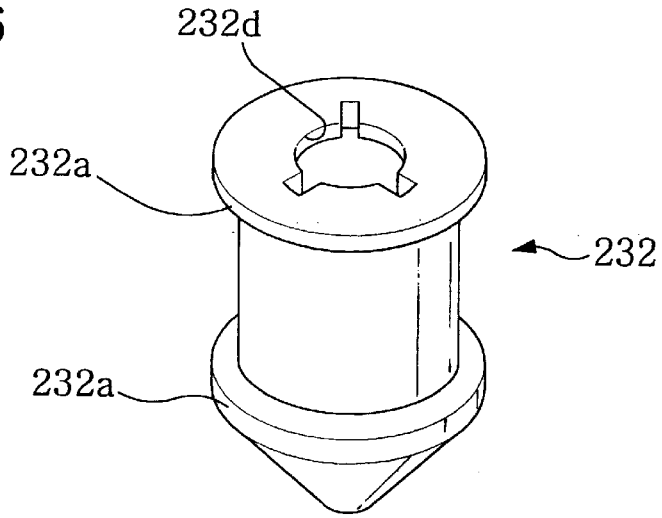
FIG. 16 is a perspective view showing the plunger head of the beverage container.
Figure 17:
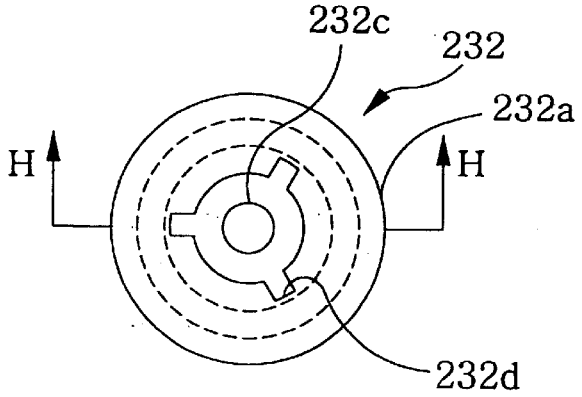
FIG. 17 is a plan view of FIG. 16.
Figure 18:
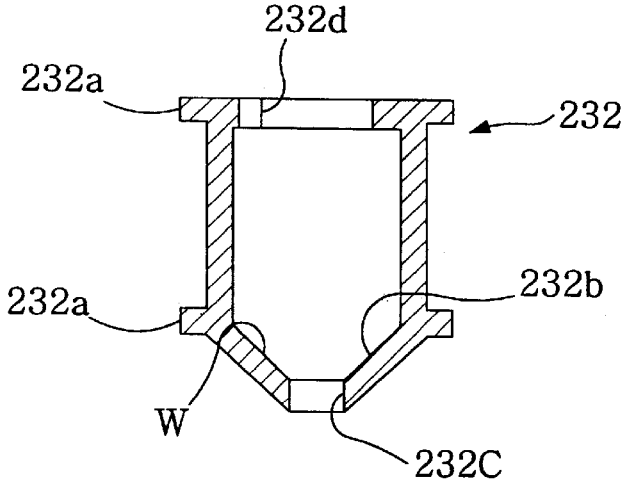
FIG. 18 is a cross section taken along line H—H of FIG. 17.

FIG. 1 is a vertical cross section showing a beverage container in a state where the beverage container cannot discharge beverage out of the beverage container. FIG. 2 is a vertical cross section showing the beverage container in a state where the beverage container can discharge beverage out of the beverage container.

A beverage container of the present invention comprises a container body 100 for containing carbonated beverage D and a pumping lid assembly 200 for pressuring the interior of the container body 100, supplying exterior air into the interior of the container body 100, and selectively opening and closing the mouth of the container body 100. The pumping lid assembly 200 is mounted over the opening 110 of the container body 100.

The pumping lid assembly 200 includes an extension cylinder 210 engaged at its lower portion with the upper end portion of the container body 100 and provided at its sidewall with a first beverage outlet 212*b* for discharging carbonated beverage contained in the container body 100 in the outside. A pump housing 220 is rotatably mounted in the interior of the upper portion of the extension cylinder 210 and provided at its sidewall with a second beverage outlet 222*a*. A plunger assembly 230 is fitted into the central portion of the pump housing 220. The plunger assembly 230 is designed to pressurize air in the interior of the container body 100 while being moved downward, to suck exterior air from the outside while being moved upward, and to rotate together with the pump housing 220 and align the first and second beverage outlets 212*b* and 222*a* so as to discharge carbonated beverage out of the container body 100 when being rotated appropriately. A beverage guide member 240 is fixed to the interior of the extension cylinder 210, extended to the interior of the container body 100 and provided at its sidewall with a plurality of second air outlets (will be described).

The plunger assembly 230 includes a plunger body 231 fitted into the central portion of the pump housing 220 to be reciprocated upward and downward and to be rotated together with the pump housing 220. A plunger head 232 is fitted around the lower end of the plunger body 231 and is formed of elastic material. The plunger head 232 is designed to pressurize the interior of the container body 100 while being moved downward and to suck exterior air from the outside while being moved upward.

Additionally, an extension tube 250 is fixedly fitted at its upper end into the lower end of the beverage guide member 240 to be positioned near the bottom of the container body 100.

A locking ring 260 is fitted on the upper end of the extension cylinder 210 so as to prevent the pump housing 220 mounted in the interior of the upper portion of the extension cylinder 210 from being removed from the extension cylinder 210.

A spout tube 270 of a predetermined length is fitted into the first beverage outlet 212*b* of the extension cylinder 210 so that the beverage contained in the containing body 100 is capable of being discharged to a user's mouth or being poured into a vessel.

A plurality of leakage preventing members 280 are disposed around the outer surface of the pump housing 220 while being spaced apart from each other, so as to prevent the beverage being discharged through the first and second beverage outlets 212*b* and 222*a* from leaking between the inner surface of the extension cylinder 210 and the outer surface of the pump housing 220.

In such a case, the leakage preventing members preferably are O-rings.

In addition, a leakage preventing member 290, such as an O-ring, is disposed on the upper end of the containing body 100 so as to prevent beverage from leaking between the inner surface of the extension cylinder 210 and the outer surface of the container body 100.

Hereinafter, the construction of the beverage container according to the present invention is described in more detail.

As shown in FIGS. 1 to 5, the extension cylinder 210 has an engaging portion 211 provided with an internally threaded sub-portion 211*a* for engaging with the upper end portion of the container body 100. A pump support portion 212 is extended from the engaging portion 211, and is provided with a support projection 212*a* for supporting the lower end of the pump housing 220 and the first beverage outlet 212*b* for discharging beverage contained in the container body 100 to the outside.

An engaging groove 212*c* for engaging with the locking ring 260 is formed on the upper portion of the outer surface of the extension cylinder 210.

In order to facilitate the assembly of the beverage container, the outer surface of the engaging portion 211 of the extension cylinder 210 is preferably knurled.

As illustrated in FIGS. 1, 2 and 6 to 8, the pump housing 220 has a cylindrical portion 221 for accommodating the plunger head 232 to move upward and downward. The pump housing 220 is further provided with an air valve 233 at its bottom. A support skirt portion 222 is formed around the cylindrical portion 221 and supported by the support projection 212*a* of the pump support portion 212 of the extension cylinder 210.

The cylindrical portion 221 of the pump housing 220 is opened at its top and closed at its bottom. An engaging hole 221*a* for engaging with the air valve 233 is formed on the center of the bottom of the cylindrical portion 221, and a plurality of first air discharge holes 221*b* for discharging air are formed around the engagement hole 221*a* on the bottom of the cylindrical portion 221.

The support skirt portion 222 of the pump housing 220 is provided with the second beverage outlet 222*a* to communicate with the first beverage outlet 212*b* of the extension cylinder 210. A plurality of circular grooves 222*b* are formed on the outer surface of the support skirt portion 222 while being vertically spaced apart from each other, and serve to accommodate the leakage preventing members 280. A plurality of radial grooves 222*c* are formed on the upper surface of the support skirt portion 222 so as to rotate the pump housing 220 together with the plunger assembly 230.

As shown in FIGS. 1, 2, and 9 to 12, the plunger body 231 has a grip 231*b* provided at the lower surface of the grip 231*b* with a plurality of radial projections 231*a* that are spaced apart from one another and engaged with the radial grooves 222*c* of the pump housing 220. A plunger rod portion 231*c* is vertically extended from the grip 231*b*. A top-shaped pumping portion 231*d* is formed on the lower end of the plunger rod portion 231*c*.

A circular groove 231*e* is formed on the upper surface of the pumping portion 231*d*, and a plurality of vertical slits 231*f* are formed on the side surface of the pumping portion 231*d* to communicate with the circular groove 231*e*.

The plunger rod portion 231*c* preferably has a cross-shaped sectional figure. This is because the cross-shaped sectional figure facilitates the injection molding of the plunger rod portion 231*c* and prevents the plunger rod portion 231*c* from being contracted during the injection molding of the plunger rod portion 231*c*.

As shown in FIGS. 1, 2 and 13 to 15, the beverage guide member 240 has a fixed portion that is fitted into the support skirt portion 222 of the pump housing 220 and the support projection 212*a* of the extension cylinder 210. A cylinder portion 242 is parallel extended toward the interior of the container body 100, fitted in the pump support portion 212 of the extension cylinder 210, and is provided with a plurality of second air discharge holes 24*a*. A funnel portion 243 is diminished downward and accommodates the upper end of the extension tube 250.

As shown in FIGS. 1, 2 and 16 to 18, the plunger head 232 has a cylindrical portion 232*a* that is tightly accommodated in the cylindrical portion 221 of the pump housing 220 to be moved together with the plunger body 231. A bottom portion 232*b* is extended from the lower end of the cylindrical portion 232*a* to have a tapered surface W conforming to the bottom surface of the plunger body 231, and has a through hole 232*c* at the apex of the bottom portion 232*b*. A top portion (reference numeral not assigned) is formed on the upper end of the cylindrical portion 221 and provided with an air passage 232*d*.

The air passage 232*c* is constructed by forming a plurality of regularly spaced slits around a center hole.

Figure 19:
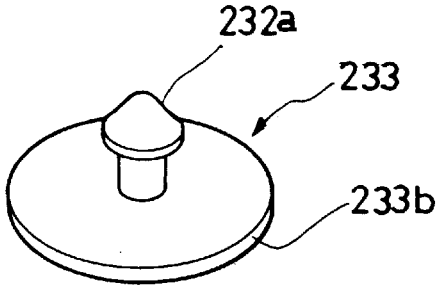
FIG. 19 is a perspective view showing the air valve of the beverage container.
Figure 20:
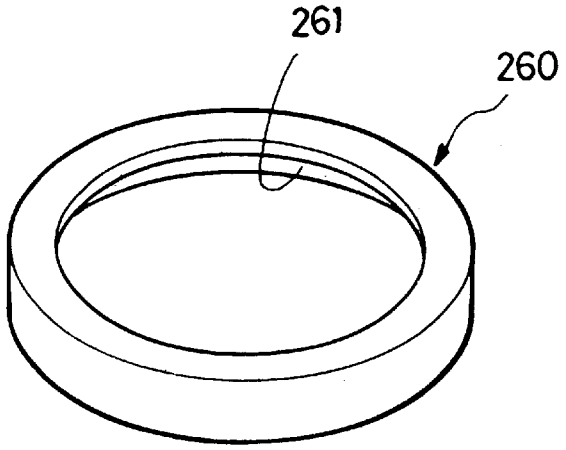
FIG. 20 is a perspective view showing the locking ring of the beverage container.
Figure 21:
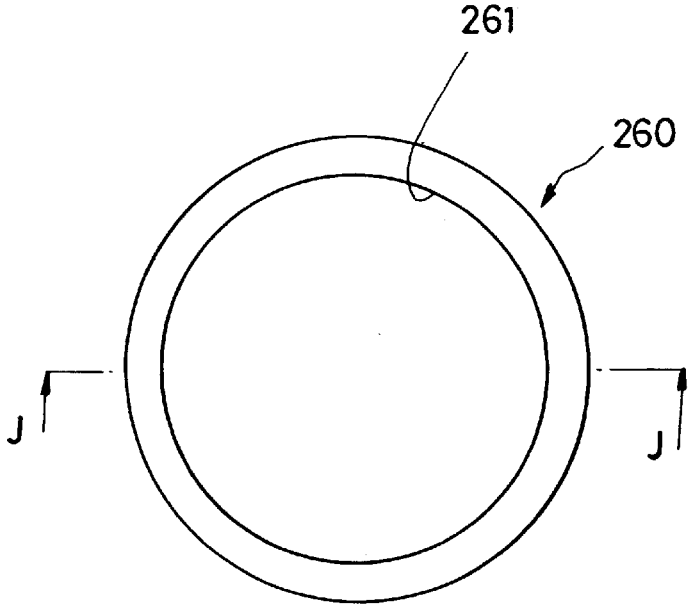
FIG. 21 is a plan view of FIG. 20.
Figure 22:
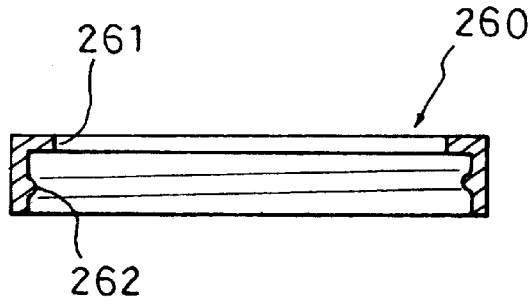
FIG. 22 is a cross section taken along line J—J of FIG. 21.
Figure 23:
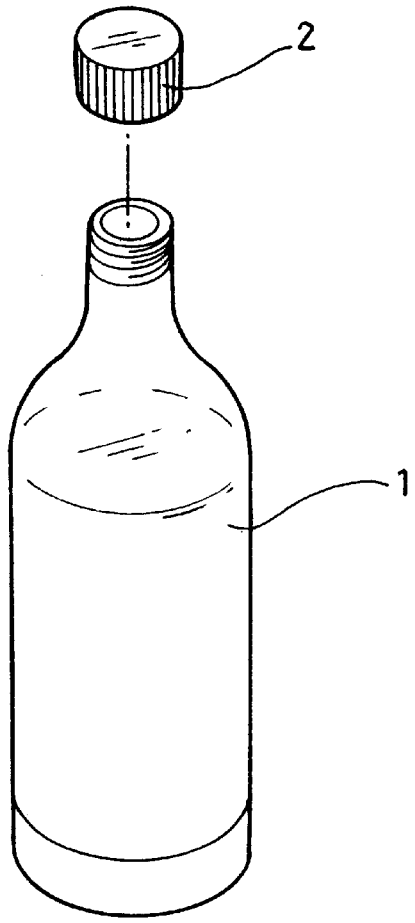
FIG. 23 is an exploded perspective view of a conventional beverage container.

The air valve, as shown in FIGS. 1, 2 and 19, has an arrowhead portion 232*a* that is inserted into the engaging hole 221*a*. A circular valve body 233*b* is formed on the lower end of the arrowhead portion 232*a* to cover the lower ends of the first air discharge holes 221*b*.

As depicted in FIGS. 1, 2 and 20 to 22, the locking ring 260 has a bent upper portion and a center hole 261 so as to prevent the cylindrical portion 221 of the pump housing 220 from being removed from the extension cylinder 210. The locking ring 260 is further provided with a projection ring 262 that is inserted into the engaging groove 212*c* of the extension cylinder 210.

Hereinafter, the operation of the beverage container according to the present invention is described.

In a state where the beverage container is assembled as shown in FIG. 1, when the plunger assembly 230 of the pumping lid assembly 200 is manipulated, the flavor of the carbonated beverage can be maintained for a long time because the pressure in the container body 100 is increased and the carbon dioxide dissolved in the carbonated beverage in the container body 100 is prevented from coming out of the carbonated beverage into the vacant space of the container body 100.

In more detail, when the plunger assembly 230 is pushed downward, air is pressed through the first air discharge holes 221*b* of the pump housing 220 and the air valve 233 into the interior of the container body 100 because the plunger body 231 is moved downward while the pumping portion 231*d* of the plunger body 231 stops up the through hole 232*c* of the plunger head 232.

Thereafter, when the plunger assembly 230 is pulled upward, the plunger body 231 is moved upward while the pumping portion 231*d* of the plunger body 231 is removed from the through hole 232*c* of the plunger head 232. At this time, since the first air discharge holes 221*b* of the pump housing 220 are closed by the air valve 233, the exterior air enters through the space between the lower surface of the grip 231*b* and the upper surface of the pump housing 220 and enters the interior of the cylindrical portion 221 through the plunger rod portion 231*c*, the air passage 232*d*, the circular groove 231*e*, the vertical slits 231*f* and the through hole 232*c*.

In the meantime, when the plunger assembly 230 is rotated from a state shown in FIG. 1, the first and second beverage outlets 212*b* and 222*a* may be aligned as shown in FIG. 2 because the plunger assembly 230 is rotated together with the pump housing 220, with the radial projections 231*a* of the plunger assembly 230 engaged with the radial grooves 222*c* of the pump housing 220. Accordingly, the beverage D contained in the container body 100 is raised through the extension tube 250 and the beverage guide member 240 and is discharged through the second beverage outlet 222*a*, the first beverage outlet 212*b* and the spout tube 270.

In this state, when the plunger assembly 230 is repeatedly moved upward and downward, the carbonated beverage D is continuously discharged out of the beverage container.

Thereafter, when the plunger assembly 230 is rotated from a state shown in FIG. 2, the alignment of the first and second beverage outlets 212*b* and 222*a* are cancelled as shown in FIG. 1 because the plunger assembly 230 is rotated together with the pump housing 220, with the radial projections 231*a* of the plunger assembly 230 engaged with the radial grooves 222*c* of the pump housing 220.

In this state, when the plunger assembly 230 is repeatedly moved upward and downward, the pressure in the container body 100 is increased and the carbon dioxide dissolved in the carbonated beverage in the container body 100 is prevented from coming out of the carbonated beverage into the vacant space of the container body 100, thereby maintaining the flavor of the carbonated beverage for a long time.

As described above, the present invention provides a beverage container, which is capable of preventing carbon dioxide dissolved in the carbonated beverage of the beverage container from coming out of the beverage into the vacant space of the beverage container by pressurizing the interior of the beverage container by means of the action of its pumping construction, thereby allowing sufficient carbon dioxide to be retained in the beverage and accordingly maintaining the flavor of the carbonated beverage for a long time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A beverage container, comprising:

a container body for containing carbonated beverage; and a pumping lid assembly for selectively opening and closing the container body, which is inserted into an opening of the container body, said pumping lid assembly including, an extension cylinder engaged at its lower portion with an upper end portion of the container body and provided at its sidewall with a first beverage outlet for discharging carbonated beverage contained in the container body, a pump housing rotatably mounted in the interior of the upper portion of the extension cylinder and provided at its sidewall with a second beverage outlet, a plunger assembly fitted into the central portion of the pump housing, said plunger assembly being designed to pressurize air in the interior of the container body while being moved downward, to suck exterior air from the outside while being moved upward, and to rotate together with the pump housing and align the first and second beverage outlets so as to enable the discharge of carbonated beverage from the container body when being rotated, and a beverage guide member fixed to the interior of the extension cylinder, extended to the interior of the container body and provided at its sidewall with an air outlet.

2. The beverage container according to claim 1, wherein said plunger assembly comprises, a plunger body fitted into a central portion of the pump housing to be reciprocated upward and downward and to be rotated together with the pump housing, and a plunger head fitted around a lower end of the plunger body and formed of elastic material, said plunger head being designed to pressurize air in an interior of the container body while being moved downward and to suck exterior air from the outside while being moved upward.

3. The beverage container according to claim 1, further comprising an extension tube, said extension tube being inserted at its upper end into the lower end of the beverage guide member to be positioned near the bottom of the container body.

4. The beverage container according to claim 1, further comprising a locking ring fitted on an upper end of the extension cylinder so as to prevent said pump housing mounted in the interior of the upper portion of the extension cylinder from being removed from the extension cylinder.

* * * * *